US007487816B2

(12) United States Patent
Moriya et al.

(10) Patent No.: US 7,487,816 B2
(45) Date of Patent: Feb. 10, 2009

(54) TAKE UP-TYPE SCREEN DEVICE

(75) Inventors: Hirofumi Moriya, Tokyo (JP); Takashi Moriya, Tokyo (JP)

(73) Assignee: Seiki Sogyo Co., Ltd., Tokyo (JP)

( * ) Notice: Subject to any disclaimer, the term of this patent is extended or adjusted under 35 U.S.C. 154(b) by 209 days.

(21) Appl. No.: 10/515,187

(22) PCT Filed: May 27, 2003

(86) PCT No.: PCT/JP03/06607

§ 371 (c)(1),
(2), (4) Date: Jun. 10, 2005

(87) PCT Pub. No.: WO03/102344

PCT Pub. Date: Dec. 11, 2003

(65) Prior Publication Data

US 2005/0230065 A1 Oct. 20, 2005

(30) Foreign Application Priority Data

May 31, 2002 (JP) ..... 2002-160407

(51) Int. Cl.
*E06B 9/08* (2006.01)

(52) U.S. Cl. ..... 160/31; 160/296; 160/315; 160/23.1

(58) Field of Classification Search ..... 160/23.1, 160/24, 31, 267.1, 271, 274, 275, 290.1, 160/294, 293.1, 295, 296, 305, 315, 318; 242/385, 385.1, 375.1, 375.2, 385.2, 385.3, 242/385.4

See application file for complete search history.

(56) References Cited

U.S. PATENT DOCUMENTS 1,779,646 A * 10/1930 Traut ..... 160/271

(Continued)

FOREIGN PATENT DOCUMENTS

JP 5-222885 8/1993

(Continued)

OTHER PUBLICATIONS

U.S. Appl. No. 10/515,185, filed Nov. 29, 2004, Moriya, et al.

(Continued)

*Primary Examiner*—Blair M. Johnson
(74) *Attorney, Agent, or Firm*—Oblon, Spivak, McClelland, Maier & Neustadt, P.C.

(57) ABSTRACT

A retractable screen device including a screen frame formed by upper and lower frame members and right and left side frames, each having a fixed cross section along its entire axis, and corner linking members linking the ends of the frame members and side frames together at four corners of the screen frame. One of a pair of corner linking members situated at the ends of the side frame carrying a screen winding shaft includes a winding mechanism that is movable into and out of the winding shaft to cause the winding shaft to wind a screen thereon with aid of an adjustable spring force, while the other corner linking member includes a stopper mechanism that is movable into and out of the winding shaft to define an adjustable limit to a degree of unwinding of the screen from the winding shaft.

2 Claims, 5 Drawing Sheets

U.S. PATENT DOCUMENTS

| | | | | | |
|---|---|---|---|---|---|
| 1,792,771 | A * | 2/1931 | Sevison | 160/318 |
| 1,972,182 | A * | 9/1934 | Chamberlain, Jr. et al. | 160/276 |
| 2,020,595 | A * | 11/1935 | Weber | 160/295 |
| 3,965,960 | A * | 6/1976 | Massey | 160/295 |
| 4,429,729 | A * | 2/1984 | Winslow | 160/315 |
| 4,523,620 | A * | 6/1985 | Mortellite | 160/315 |
| 5,078,198 | A * | 1/1992 | Tedeschi | 160/315 |
| 5,219,015 | A * | 6/1993 | Kraeutler | 160/271 |
| 5,271,446 | A * | 12/1993 | Hwang | 160/23.1 |
| 6,059,007 | A * | 5/2000 | Tomita | 160/242 |
| 6,263,942 | B1 * | 7/2001 | Miller | 160/23.1 |
| 6,390,403 | B2 * | 5/2002 | Specht | 242/374 |
| 6,408,922 | B2 * | 6/2002 | Desrochers | 160/24 |
| 6,470,951 | B1 * | 10/2002 | Tao | 160/176.1 R |
| 6,536,502 | B2 * | 3/2003 | Britto et al. | 160/23.1 |
| 6,629,555 | B2 * | 10/2003 | DeBlock et al. | 160/31 |
| 6,701,994 | B2 * | 3/2004 | Goldenberg et al. | 160/31 |
| 6,749,142 | B2 * | 6/2004 | Arisaka et al. | 242/381 |

FOREIGN PATENT DOCUMENTS

| | | |
|---|---|---|
| JP | 9-78964 | 3/1997 |
| JP | 2000-17974 | 1/2000 |

OTHER PUBLICATIONS

U.S. Appl. No. 10/515,187, filed Nov. 29, 2004, Moriya, et al.

* cited by examiner

TAKE UP-TYPE SCREEN DEVICE

BACKGROUND OF THE INVENTION

1. Field of the Invention

The present invention relates to a retractable screen that is installed in the opening portion of a building for the purpose of insect-proofing, light-shielding, heat insulation, and as a blind, and specifically relates to an improved retractable screen device wherein, by cutting edge portions for the upper and lower frame material and the right and left side frames in an arbitrary length, and using corresponding corner linking material to link these together, the dimensions can be easily made to fit the opening portion of a building even if the user is not well-practiced in this skill.

2. Discussion of the Background

In general, retractable screen devices have been widely known that are installed in an opening portion of a building for the purpose of insect-proofing, light-shielding, heat insulation, shading, and so forth. In the case of installing such retractable screen devices in the opening portion of a building, the screen frame needs to be of the dimensions that fit with the size of the opening, and this dimension fitting is performed by cutting the upper and lower frame material and the left and right side frames in the necessary length corresponding to the aforementioned opening portion dimensions, and linking the edge portions of the upper and lower frame material and the left and right side frames with corresponding corner linking material.

However, if the dimension fitting is only for this type of screen frame, the user and others can perform this relatively easily, and therefore the necessary materials and parts can be sold as a set, but in the case of a screen device that comprises a winding mechanism wherein the screen is wound on to a winding shaft using a spring for winding, the assembly of the winding mechanism is not necessarily simple, and also latter-described problems may occur, and therefore the user must either obtain a product that fits the dimensions of the building opening portion, or hire a professional worker for the dimension adjustment work.

In other words, with the screen device described above which enables dimension fitting, the upper and lower frame material is shortened according to the width of the building opening portion, and the length of the screen to be pulled out is shortened accordingly, resulting in not only the necessity to adjust the strength of the winding spring, but the remaining screen is in the state of being wound on the winding shaft even in the state wherein the screen is spread over the screen frame, and therefore the screen can bend widely due to the wind or other external forces, and it becomes necessary to consider countermeasures.

In particular, in the case that a winding shaft is provided on the left and right side frames and the screen is open both on the left and right sides, the winding shaft that winds each screen has an additional screen wound onto it, and therefore in the case of pulling out each screen to spread them, only enough screen to cover half of the building opening width needs to be pulled out, but because of the additional allowance in the length of the screen, the screen can possibly be pulled out further than the pullout limit, and a countermeasure becomes necessary, such as the user keeping this in mind at the time of use, or providing a stopper to set the pullout limit.

Further, in the case that the length of the screen has an additional allowance and the screen is pulled out more than necessary due to an external force such as the wind and bends widely, the upper and lower edges of the screen can be derailed from the guide grooves of the upper and lower frame, and if the screen is wound onto the winding shaft in this state, one portion of the screen is over the guide groove wall, and so from this portion on is wound in a wrinkled state and opening and closing of the screen thereafter is not smooth. Therefore, the appropriate setting of the above-described screen unwinding limit is important, but even with such settings the upper and lower edges of the screen may be derailed from the guide grooves, and therefore consideration is necessary for the screen to be wound smoothly even in the case of derailing.

DISCLOSURE OF INVENTION

A technical object of the present invention is to provide a retractable screen device wherein a retractable screen device equipped with a winding mechanism for propagating the pressure force of the spring for winding the screen to this winding shaft is installed in the opening portion of a building, in which case the upper and lower frame material and the right and left side frames of the screen frame are cut to the necessary lengths corresponding to the aforementioned opening portion dimensions, and the dimensions fitting the size of the opening portion are easily adjustable.

Another technical object of the present invention is to provide a retractable screen device wherein the retractable screen device is equipped with a winding device, and when the dimensions of the upper and lower frame material and the right and left side frames of the screen frame are adjusted to correspond with the aforementioned opening portion dimensions, the adjustment of the winding force of the aforementioned winding mechanism and the setting of the limits for pulling out the screen can be performed easily.

Another technical object of the present invention is to provide a retractable screen device wherein the screen can be wound smoothly even if the upper and lower edges of the screen derail from the guide grooves.

Yet another technical object of the present invention is to provide convenience in both the manufacturing and assembling of the above-described retractable screen device as much as possible.

With a retractable screen device according to the present invention for solving the aforementioned problems, a screen frame is configured by cutting edge portions for the upper and lower frame material and the right and left side frames in an arbitrary length, and using corner linking material to link these by alternately attaching these linking portions, one edge of the screen if a single screen, and one edge from each side for a screen that opens to both the left and right, to be spread within this frame is wound onto the winding shaft provided on one side of the aforementioned side frame, and the other edge of this screen is linked to a movable rail that is guided by the frame body of the aforementioned upper and lower units; wherein a winding mechanism is provided on one side of the corner linking material of both edges of the side frame providing the aforementioned winding shaft, so as to be capable of insertion into or removal from the winding shaft, to which the pressing force of an adjustable spring for linking to the winding shaft and winding the screen to this winding shaft is propagated; and a stopper mechanism is provided on the other side of the aforementioned linking material, so as to be capable of insertion into or removal from the winding shaft, wherein the limit of the screen unwinding by the rotation of the winding shaft is adjustable.

With the winding mechanism according to the above retractable screen device, a spring receptacle on the base edge side for inserting into the winding shaft and a spring support shaft that is fixed thereupon is provided to the corner linking material via a clutch mechanism, and while one edge of the winding spring is wound and fixed to the aforementioned base edge side spring receptacle, the other edge of the spring wound and fixed to the winding shaft side spring receptacle provided on the spring support shaft so as to be capable of rotating, and the spring receptacle on this winding shaft side rotates integrally with the winding shaft, but is attached to the winding shaft in the axial direction of the winding shaft so as to be capable of moving; wherein the aforementioned clutch mechanism prevents the base edge side spring receptacle from rotating due to the spring pressing force, but the rotation of the operation ring provided on the corner linking material can be propagated to the spring support shaft for the purpose of adjusting the pressing force of the spring for winding the screen.

Further, with the stopper mechanism according to the aforementioned retractable screen device, the screw shaft for inserting the corner linking materials into the winding shaft is linked via the clutch mechanism, and a nut that rotates integrally with the winding shaft but is capable of moving in the axial direction is screwed in to this screw shaft, and a stopper for setting the limit of the nut advancing is provided on the aforementioned screw shaft, and is configured so that when the winding shaft is rotated in the screen unwinding direction the nut advances along the screw shaft towards the stopper; and the aforementioned clutch mechanism prevents rotation of the screw shaft from rotating due to the rotational force of the winding shaft and so forth, but the rotation of the operation ring provided on the corner linking material can be propagated to the screw shaft for the purpose of adjusting the limit of the screen unwinding.

With the retractable screen device that has the aforementioned configuration, the upper and lower frame material and the right and left side frames of the screen frame are cut to the necessary lengths to correspond with the dimensions of the building opening portion, and by mutually fitting and linking these edge portion to the portions linking with corner linking material, a screen frame can be configured wherein the dimension thereof fits the size of the building opening portion, and this is equipped with a winding mechanism for winding the screen by pressing force of a spring, wherein this winding mechanism is provided on the corner linking material of one edge of the side frame on which is provided the aforementioned winding shaft, and because this can be inserted or removed from the winding shaft, even if the side frame equipped with the winding shaft is adjusted to an arbitrary length, the assembly of the winding mechanism to the screen frame can be performed easily.

Additionally, this winding mechanism is adjustable from the outside after assembling the spring pressing force for winding the spring, because of the operating ring provided on the corner linking material, and therefore, even if the screen frame dimensions are set arbitrarily, the screen winding force on the winding shaft can be set appropriately.

Further, on the other side of the aforementioned corner linking material a stopper mechanism is provided that is capable of adjusting the limit of screen unwinding by the rotation of the winding shaft, and therefore by performing the appropriate adjustments thereof, even if the length of the upper and lower frame material is arbitrarily set, the additional allowance of the screen that is wound onto the winding shaft will not widely bend due to the wind or another external force, and even in the case that the screen opens to both the left and right by providing winding shafts on the left and right side frames, the additional screen will not be pulled out more to cover more than ½ the area of the building opening width. Further, the aforementioned stopper mechanism is capable of adjusting the screen unwinding limit arbitrarily from the outside by the operating ring provided on the corner linking material, and therefore, even if the dimensions of the upper and lower frame material are set arbitrarily, the appropriate unwinding length can be easily set. Further, by providing this stopper mechanism, the length of the screen does not need to be cut short to fit with the dimensions of the upper and lower frame material when assembling the screen device.

Additionally, the stopper mechanism is provided on the corner linking material so as to be capable of inserting into or removing from the winding shaft, and therefore similar to the case of the aforementioned winding mechanism, even if the side frames are adjusted to an arbitrary length, the assembly of the stopper mechanism to the screen frame can be performed easily.

With the aforementioned retractable screen device, guide grooves are provided to guide the upper and lower edges of the screen along the upper and lower frame material, and an extension portion for the aforementioned guide groove is provided on the corner linking material that is positioned on the upper and lower edges of the side frame equipped with the winding shaft, and a guide groove for returning the screen derailed from the guide groove when winding the screen on to the winding shaft into the extension portion in the groove wall wherein the extension portion is configured is provided along the winding width of the screen on the winding shaft, which is effective for winding the screen that is pulled out from the guide groove smoothly onto the winding shaft so as not to have any wrinkles, and at the same time for returning the screen derailed from the groove back into the correct position along with the winding.

Further, with the aforementioned retractable screen device, by making the left and right side frames and the rail material for the movable rail and the winding shaft for the screen the same length, and also making the upper and lower frame material the same length, a movable rail that fits the screen frame can be formed, or alternatively, making the upper and lower frame material common, the corner linking material of the upper and lower material is formed vertically symmetrically, except for the winding mechanism and the stopper mechanism, wherein both edges of the winding shaft are supported by the supporting face of the corner linking material via a washer, so as to be capable of rotating, and the screen frame can be used when turned upside down, and thus is effective when considering the convenience of manufacturing, assembly, and construction.

DETAILED DESCRIPTION OF PREFERRED EMBODIMENTS

Figure 1:
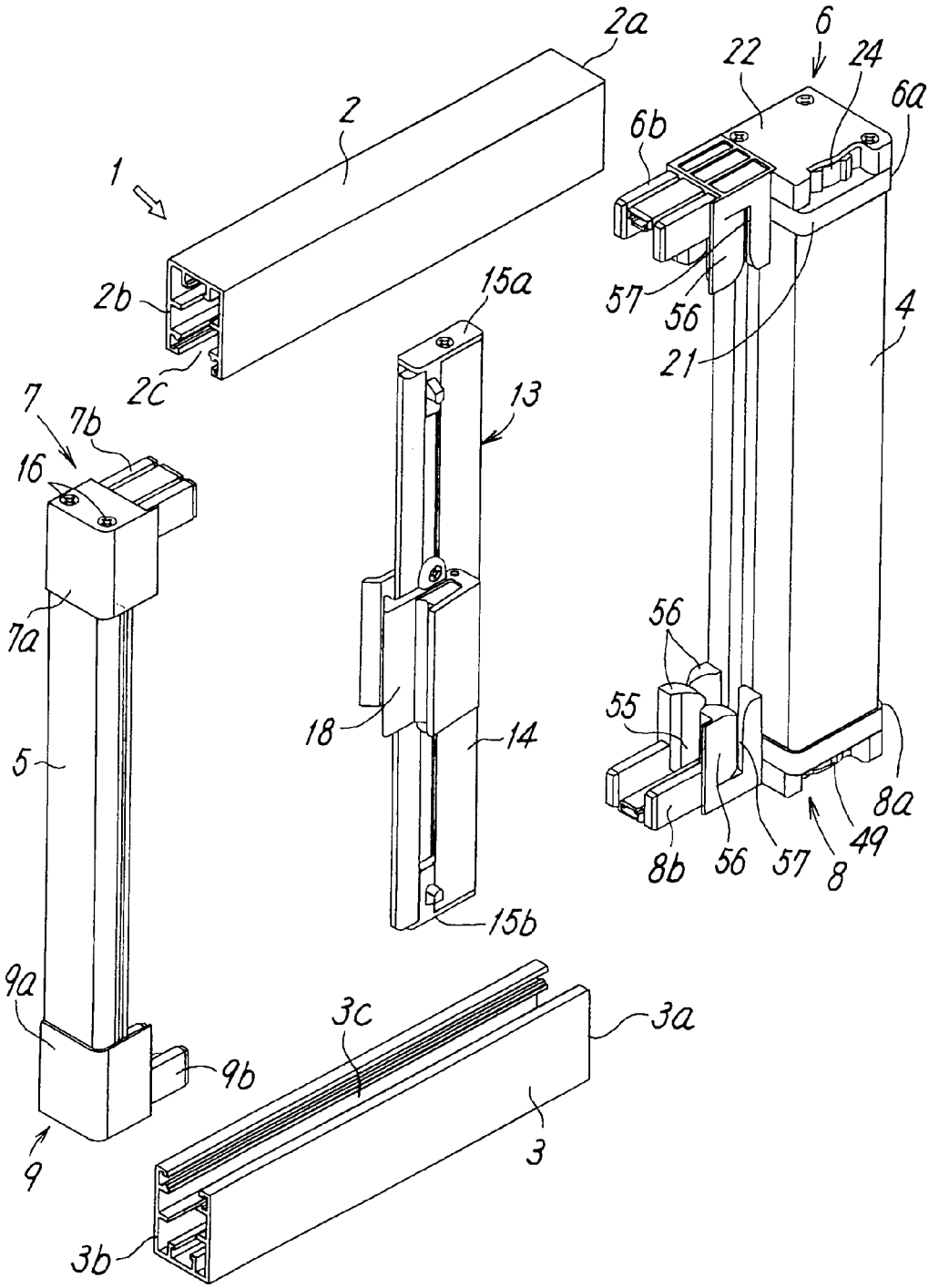
FIG. 1 is a disassembled perspective view illustrating a first embodiment of a retractable screen device relating to the present invention.
Figure 2:
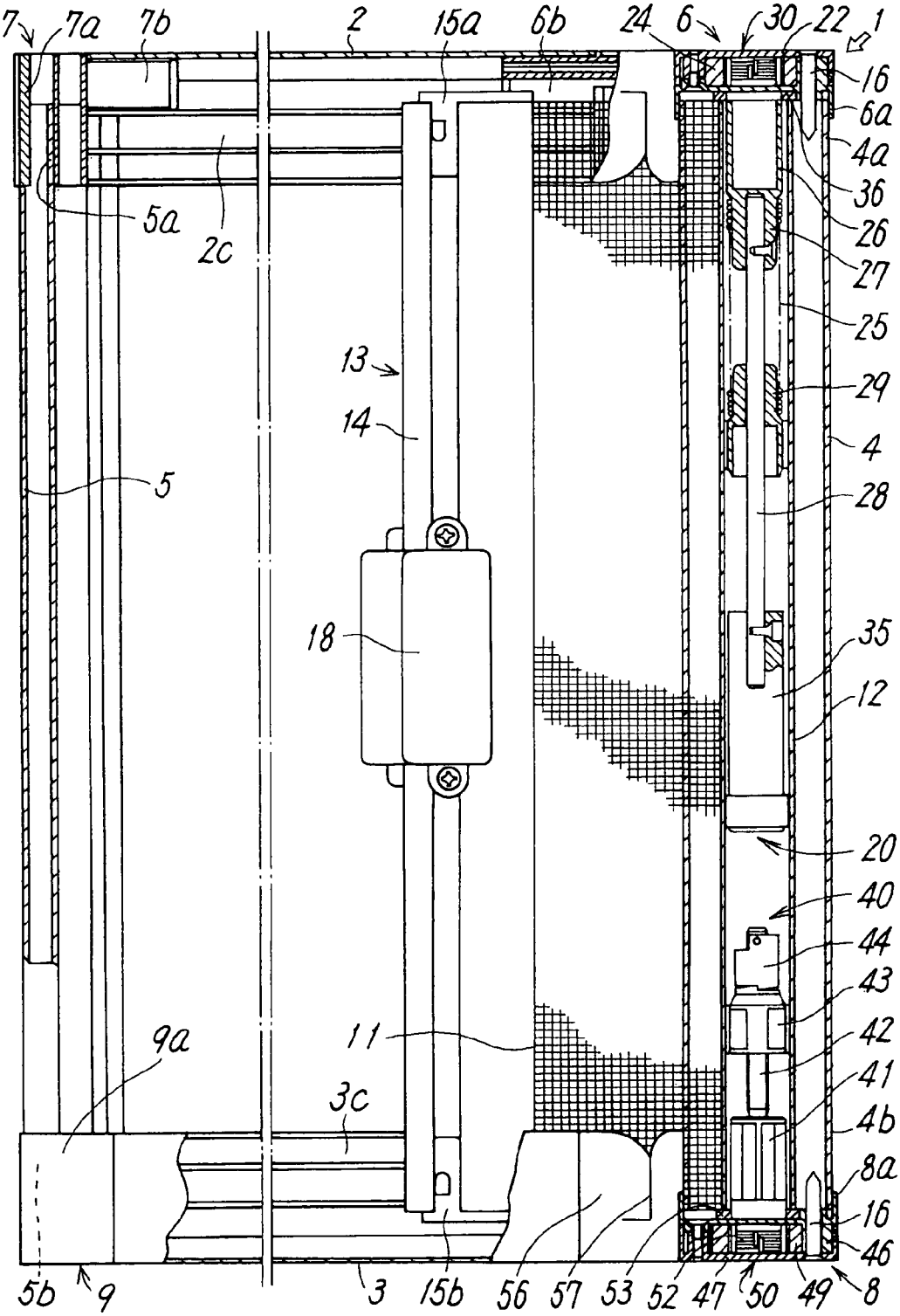
FIG. 2 is a partial cutaway frontal view of the embodiment.
Figure 3:
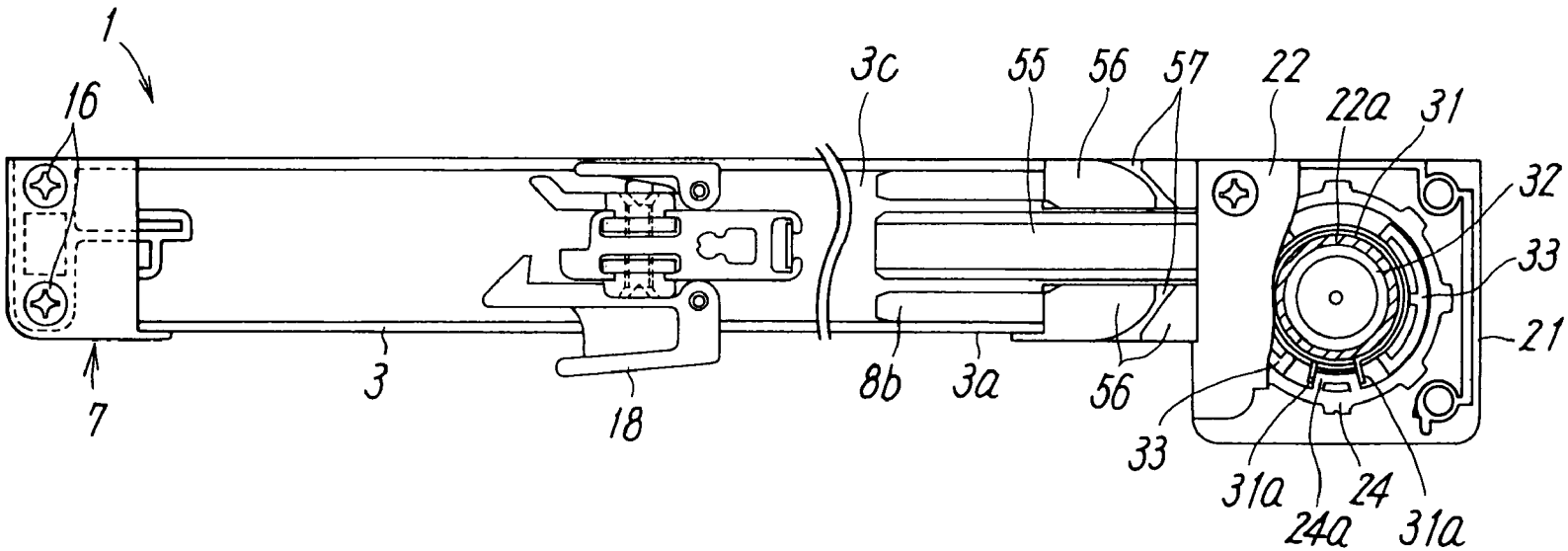
FIG. 3 is a plan cross-sectional view of the embodiment.
Figure 4:
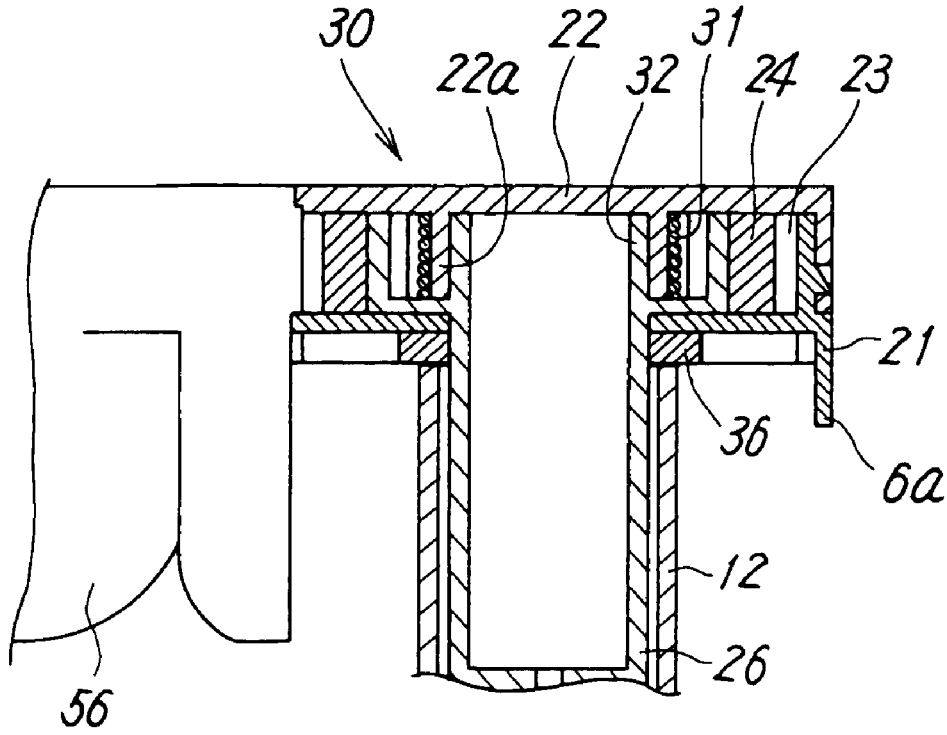
FIG. 4 is an enlarged cross-sectional view of the principal portions of the corner linking material having a winding mechanism.

FIG. 1 through FIG. 4 illustrate one embodiment wherein a retractable screen device relating to the present invention is used as an insect-prevention screen door, and this retractable screen device includes a screen frame 1 that comprises upper and lower frame material 2 and 3 and left and right side frames 4 and 5, which are linked with corner linking material 6, 7, 8, and 9. The aforementioned upper and lower frame material 2 and 3 are configured with a fixed cross-section by using a common extrusion material of such as aluminum or plastic, and can be cut to an arbitrary length to fit the opening width of the building opening portion.

Further, the above-mentioned pair of side frames 4 and 5 are an example of the illustrated state of the screen device with one side being opened, and the one side frame 4 comprises a winding box that houses a winding shaft 12 of a screen 11, and the other edge of the screen 11 wherein one edge is fixed on this winding shaft 12 is fixed to a movable rail 13 that guides the upper and lower frame body 2 and 3, and by moving this movable rail 13 to the position of the side frame 5 on the other end, the screen 11 is spread across the entirety of the screen frame 1. With the screen device thus configured, the aforementioned one side frame 4 only is configured as the winding box, and the other side frame 5 is configured as the rail receptacle that receives the movable rail 13 when the screen is spread. However, in the case to be described below, wherein both sides are opened, both side frames 4 and 5 are configured as winding boxes.

By linking the edge portions of the upper and lower frame material 2 and 3 and the right and left side frames 4 and 5 that are cut to an arbitrary length with the corresponding corner linking materials 6 through 9, the aforementioned screen frame 1 is configured. The upper and lower corner linking material 6 and 8 that link the space between the aforementioned upper and lower frame material 2 and 3 and the upper and lower edges of the side frame 4 that make up the winding box are formed to be vertically symmetrical, except for the winding mechanism 20 and the stopper mechanism 40 to be described below that are linked thereto, and the linking of the corner linking material 6 and 8 and the side frame 4 is made by fitting and abutting linking portions 4*a* and 4*b* of the upper and lower edges of the side frame 4 to linking portions 6*a* and 8*a* that are on the corner linking material 6 and 8, and fastening with screws 16 from the upper and lower edges. Further, the corner linking material 6 and 8 and the upper and lower frame material 2 and 3 are linked, as clearly illustrated in FIG. 1, by fitting and abutting linking portions 6*b* and 8*b* of the corner linking material 6 and 8 to the linking portions 2*a* and 3*a* on the end portions of the upper and lower frame material 2 and 3, and fixing as necessary with screws and so forth.

On the other hand, the upper and lower corner linking material 7 and 9 that link the upper and lower frame material 2 and 3 and the side frame 5 that comprises a rail receptacle is formed to have an vertical symmetrical form, and similar to the case of linking the aforementioned corner linking material unit 6 and 8 and the side frame 4, the linking of the corner linking material 7 and 9 and the side frame 5 is linked by fitting and abutting the linking portions 5*a* and 5*b* of the upper and lower edges of the side frame 5 to the linking portions 7*a* and 9*a* that are on the corner linking material 7 and 9, and fastening with the screws 16 from the upper and lower edges. Further, the corner linking material 7 and 9 and the upper and lower frame material 2 and 3 are linked by fitting the linking portions 7*b* and 9*b* of the corner linking material 7 and 9 up against the linking portions 2*a* and 3*a* on the end portions of the upper and lower frame material 2 and 3, and fixing as necessary with screws and so forth.

Further, regarding the movable rail 13, similar to the side frames 4 and 5, a rail material 14 of a fixed cross-section is cut to the necessary length, and is configured by providing caps 15*a* and 15*b* to slide along the guide groove formed in the upper and lower frame material 2 and 3 on both sides. Now, this movable rail 13 is provided with a latch 18 on the concave portion of the side frame 5 that comprises the rail receptacle in the center position for retaining elastically.

The aforementioned left and right side frames 4 and 5 and the rail material 14 of the movable rail 13 and the aforementioned screen winding shaft 12 are formed to the same length, and thus the necessary screen frame 1 and the movable rail 13 that applies thereto is designed, and further, the screen frame is formed with the same length of the upper and lower frame material 2 and 3. Therefore, by cutting these raw materials to the same fixed length that correspond to the dimensions of the building opening portion with an appropriate cutting tool or a cutting device, the screen frame 1 with the predetermined size can be assembled.

The corner linking material 6 on the upper side of the side frame 4 that has the aforementioned winding shaft 12 is provided with a winding mechanism 20 that is capable of insertion to or removal from the winding shaft 12, and the corner linking material 8 on the lower side is provided with a stopping mechanism 40 that is capable of insertion to or removal from the winding shaft 12.

The aforementioned winding mechanism 20 is linked to the winding shaft 12 that supports the corner linking material 6 and 8 on both edges of the side frame 4 so as to be capable of rotating, and is to propagate the pressing force of a spring 25 for winding the screen 11 to the winding shaft 12, and the aforementioned stopping mechanism 40 is capable of adjusting the unwinding limit of the screen 11 by the rotation of the winding shaft 12.

The configurations of winding mechanism 20 and the stopper mechanism 40 will be described in detail below.

First, the corner linking material 6 equipped with the winding mechanism 20 on one edge of the side frame 4 housing the aforementioned winding shaft 12 is equipped with an end cover 22 assembled to a linking material main unit 21 and fixed with screws. The aforementioned end cover 22 forms a room 23 that houses an operating ring 24 between the linking material main unit 21, but an opening portion can be formed by notching out one portion thereof (see FIG. 1), and the operating ring 24 can be rotated and operated from the outside with the fingertips. Further, on the inside of the operating ring 24 that is in the aforementioned room 23, a clutch mechanism 30 is also housed, and a clutch cylinder 22*a* that forms one portion of the clutch mechanism 30 is formed integrally on the inner face side of the end cover 22 (see FIG. 4).

The winding mechanism 20 is equipped with a linking shaft 26 that links to the clutch cylinder 22*a* of the end cover 22, via a clutch mechanism 30 described below, and a spring support shaft 28 that is fixed to the linking shaft 26 and inserted into the winding shaft 12; and provides a spring receptacle 27 as one unit that is fixed on the front edge side of the linking shaft 26, and on the spring support shaft 28 a spring receptacle 29 on the winding shaft side that is linked to the inner face of the winding shaft 12 is supported so as to be capable of rotating, and both edges of the winding spring 25 are wound and fixed on to the spring receptacles 27 and 29.

The spring receptacle 29 on the winding shaft side rotates integrally with the winding shaft 12 by spline engaging and so forth, but is capable of movement in the axial direction of the winding shaft 12. Therefore, the winding shaft 12 is linked to the linking shaft 26, via the spring 25, that is provided in a fixed manner to the corner linking material 6 via the clutch mechanism 30, and the pressing force in the winding direction of the winding shaft 26 is provided by this spring 25.

The aforementioned clutch mechanism 30 is such that the linking shaft 26 is prevented from rotating by the rotational force from the winding shaft 12 side by linking the linking shaft 26 to the clutch cylinder 22*a* of the end cover 22 of the corner linking material 6 by the clutch mechanism 30, the rotation of the operating ring 24 that borders on the opening portion of the end cover 22 is propagated to the spring receptacle 29 via the linking shaft 26 and the spring support shaft 28 for the purpose of adjusting the pressing force of the spring 25 for winding the screen 11.

In other words, the spring receptacle 29 can be rotated in either forward or backward directions by operating the operating ring 24, and the rotation of this spring receptacle 29 twists the spring 25 while rotating the winding shaft 12, and is capable of adjusting the pressing force of the spring 25.

Next, the configuration of the aforementioned clutch mechanism 30 will be described in detail.

The clutch cylinder 22*a* provided on the inner face of the end cover 22 of the aforementioned corner linking material 6 has a clutch spring 31 wound thereupon that is pressed in the direction of reduction in diameter, and pressured against the surface of the clutch cylinder 22*a*, forming bent portions 31*a* each facing the ends of the clutch spring 31. On the other hand, on the base end of the linking shaft 26 is provided a cylinder unit 32 that is supported within the clutch cylinder 22*a* so as to be capable of rotating, and a pair of protruding portions 33 that protrude in the surrounding area of the clutch spring 31 that is wound on to the clutch cylinder 22*a*, and further, the operating ring 24 is rotatably fit to the circumferential face of the protruding portions 33, with the engaging protruding portion 24*a* provided in a protruding manner being introduced on the inner face of this operating ring 24 so as to allow sufficient space between the pair of protruding portions 33.

Further, the pair of bent portions 31*a* of the clutch spring 31 is positioned on both sides of the engaging protruding portion 24*a* provided in a protruding manner from the operating ring 24, between the protruding portion 33 provided on the base unit of the linking shaft 26. The aforementioned clutch spring 31 is pressed in the diameter reduction direction within the circumference of the clutch cylinder 22*a*, but the direction for the engaging protruding portion 24*a* to press on either of the pair of bent portions 31*a* of the clutch spring 31, by the rotation of the operating ring 24, is the direction in which the winding diameter of the clutch spring 31 becomes larger and the winding is released toward the clutch cylinder 22*a*.

Therefore, by rotating the operating ring 24 on the aforementioned clutch mechanism 30 in either direction, one of the bent portions 31*a* of both edges of the clutch spring 31 is engaged with the engaging protruding portion 24*a* provided on the inner face of the operating ring 24, and the bent portion 31*a* is moved in the direction that the winding diameter of the clutch spring 31 becomes larger. Therefore, the friction between the clutch spring 31 and the clutch cylinder 22*a* is reduced, and the operating ring 24 rotates while pressing down on the protruding portion 33 of the base unit of the linking shaft 26 by the engaging protruding portion 24*a*, and that rotation is propagated to the linking shaft 26 and propagated to the spring receptacle 29 via the spring support shaft 28.

Thus, even if the rotational force acts upon the linking shaft 26 due to the rotation force and so forth of the winding shaft 12, the direction that the protruding portion 33 of the linking shaft base unit presses on one of the pair of the bent portions 31*a* of the clutch spring 31 is the direction to make the winding diameter of the clutch spring 31 smaller and strengthen the winding towards the clutch cylinder 22*a*, and therefore, the linking shaft 26 is fixed onto the aforementioned end cover 22 on the corner linking material 6, and the rotational force is not propagated to the operating ring 24.

Further, between the aforementioned spring support shaft 28 and the winding shaft 12 is provided an oil damper 35 that houses a one-directional clutch mechanism. The linking of the oil damper 35 and the spring support shaft 28 is done similar to the aforementioned case of the spring receptacle 29, wherein the oil damper 35 rotates integrally with the winding shaft 12 by spline engaging and so forth, but is capable of moving in the axial direction of the winding shaft 12.

The one-directional clutch mechanism is such that, in the case of rotating the winding shaft 12 in the direction of spreading the screen 7 against the rotational pressing force of the spring 25, the connection between the spring support shaft 28 and the winding shaft 12 is automatically severed, and when the winding shaft rotates in the opposite direction the winding shaft 12 is linked to the spring support shaft 28 via the oil damper 35.

The oil damper 35 can be configured so as to comprise a casing that is linked to the spring support shaft 28, and a damping cylinder that propagates the rotation via a viscous fluid inside this casing, with the damping cylinder linked to the winding shaft 12 via a known one-directional clutch mechanism, but an arrangement with another appropriate construction may also be used.

Such an oil damper 35 is effective in damping the impact of the movable rail 13 colliding with the corner linking material 6, and preventing the collision sound thereof when rewinding the screen 11 with the winding spring 25, but this does not necessarily need to be provided.

The winding mechanism 20 provided on the aforementioned corner linking material 6 has the linking shaft 26, the spring support shaft 28, the spring receptacle 29, and the oil damper 35, inserted within the winding shaft 12, but the aforementioned spring receptacle 29 and the oil damper 35 is engaged and inserted into the winding shaft 12 by spline engaging or the like, and therefore, the winding shaft 12 and the corner linking material 6 and the winding mechanism 20 are linked so as to be detachable.

Specifically, the edge portions of the winding shaft 12 are supported on the circumference of the linking shaft 26 so as to be capable of rotating, and in this instance, a washer 36 is placed between the shaft edges of the winding shaft 12 and the support face that receives the winding shaft edges on the linking material main unit 21 within the corner linking material 6, and supports the edge portions of the winding shaft so as to be capable of rotating.

Next, the aforementioned stopper mechanism 40 that sets the limit for unwinding of the screen 11 provided on the corner linking material 8 will be described.

This stopper mechanism 40 is inserted into the winding shaft 12 via a clutch mechanism 50 towards the corner linking material 8, and rotatably links the support shaft 41 that support the edge portions of the winding shaft 12 and the screw shaft 42 that protrudes from the front edge thereof, and is screwed to this screw shaft 42 with a nut 43 that rotates integrally with the winding shaft 12 but that is capable of moving in the axial direction of the winding shaft 12. Further, the aforementioned screw shaft 42 is equipped with a stopper 44 that fixes the limit of the nut 43 for screwing towards the front edge, and is configured so that when the winding shaft 12 rotates in the unwinding direction of the screen 11 along with that rotation, and the nut 43 screws toward the stopper 44 along the screw shaft 42 that is in a fixed state.

The corner linking material 8 is formed so as to be vertically symmetrical with the aforementioned upper corner linking material 6, and therefore, similar to the corner linking material 6, is equipped with a linking material main unit 46 and an end cover 47.

Further, the clutch mechanism 50 prevents the rotation of the screw shaft 42 by the rotational force and so forth of the of the winding shaft 12, but the rotation of the operating ring 49 that borders on the opening portion of the end cover 47 of the corner linking material 8 can be propagated to the screw shaft 42.

Therefore, by operating the aforementioned operating ring 49, the screw shaft 42 can be rotated in either the forward or backward direction, and the rotation of this screw shaft 42 rotates integrally with the winding shaft 12, but the nut 43 that is capable of moving in the axial direction of the winding shaft 12 screws in the direction of either upper or lower along the screw shaft 42, and thus the distance between the nut 43 and the stopper 44 changes. Therefore, when the screen 11 is unwound by the rotation of the winding shaft 12, the amount of rotation of the winding shaft until the nut 43 reaches the stopper 44 changes, the thus the unwinding limit of the screen 11 can be adjusted.

The configuration of the clutch mechanism 50 is essentially the same to that of the aforementioned clutch mechanism 30, and the only point that differs from the aforementioned clutch mechanism 30 is that the aforementioned clutch mechanism 30 has a pair of protruding portions 33 and a cylinder unit 32 provided on the base edge of the linking shaft 26, whereas this clutch mechanism 50 has a cylinder unit and a pair of protruding portions that correspond to this cylinder unit 32 and protruding portion 33 on the base edge of the support shaft 41 that is inserted into the winding shaft 12.

Therefore, the clutch cylinder is provided as one unit on the inner face of the end cover 47 of the aforementioned corner linking material 8, and a clutch spring 52 is wound thereupon that is pressed in the direction of reduction in diameter, and pressed against the surface of the clutch cylinder, the both edges of the bent portion are positioned on the both sides of the engaging protruding portion provided in a protruding manner from the inner face of the operating ring 49 that borders on the opening unit of the end cover 47, and these functions do not differ from the case of the previously described clutch mechanism 30, and therefore the detailed description thereof will be omitted.

Now, with the aforementioned clutch mechanism 50, when the operating ring 49 is rotated in either direction, the rotation of the operating ring 49 is propagated to the screw shaft 42 and the nut 43 moves, but it goes without saying that even if the rotational force acts on the screw shaft 42 by the rotations force of the winding shaft 12 and so forth, the screw shaft 42 does not rotate because of the existence of this clutch mechanism 50, and the rotations force is not propagated to the operating ring 49.

Further, the aforementioned stopper mechanism 40 has the screw shaft 42 provided on the corner linking material 8, whereupon the nut 43 is screwed, inserted into the winding shaft 12, but the aforementioned nut 43 is engaged with the screw shaft 42 by spline engaging and so forth, and therefore, the winding shaft 12 and the corner linking material 8 are linked so as to be detachable. Specifically, the edge portion of the winding shaft 12 is supported on the support shaft 41 of the screw shaft 42 so as to be capable of rotating, and in this instance, a washer 53 is placed between the shaft edge of the winding shaft 12 and the support face receiving the shaft edge of the winding shaft 12 of the corner linking material 8.

Regarding the aforementioned screen device, the guide grooves 2*c* and 3*c* that guide the upper and lower edges of the screen 11 are provided on the upper and lower frame material 2 and 3, and prevent the upper and lower edges of the screen 11 from derailing from those guide grooves 2*c* and 3*c* due to an external force such as the wind, but in the case that it is derailed for some reason, if the screen 11 is wound onto the winding shaft 12 in this state, one portion of the screen 11 is over the groove wall of the guide groove, so winding may be performed with wrinkles from that portion, and in that case, the opening and closing of the screen 11 becomes unsmooth due to the wrinkles.

In order to avoid this problem, an extension portion 55 of the aforementioned guide grooves 2*c* and 3*c* are provided in a position close to the winding shaft 12, on the corner linking materials 6 and 8 that are positioned on the upper and lower edges of the side frame 4, and a guide groove 57 is provided within the area of the winding width of the screen 11 onto the winding shaft 12, that returns the screen 11 that had been derailed from the guide groove within the extension portion 55 when rewinding onto the winding shaft 12, onto both side groove walls 56 that make up the extension portions.

The guide groove 57 is provided in a diagonal direction within the guide groove extension portion 55 from the outside of the guide grooves 2*c* and 3*c*, from the direction farther from the side frame 4 towards the direction closer to the side frame 4, thus, even if one or both of the upper and lower edges of the screen 11 are derailed from the guide grooves 2*c* and 3*c*, upon the derailed portion of the screen edge being wound onto the winding shaft 12, the winding is performed smoothly because the edge portion of the screen 11 over the entire winding width of the screen 11 onto the winding shaft 12 passes through the guiding groove 57, and wrinkling does not occur with the screen 11.

Further, when the movable rail 13 moves closer to the side frame 4, the portion of the screen 11 that is derailed from the guide groove must jump the guide grooves 2*c* and 3*c* or the guide walls of the extension portions 55 thereof, but because the one edge of the screen 11 is fixed onto the movable rail 13 across the entire width, and the other edge of the screen is being properly wound onto the winding shaft 12, force is generated to return the screen 11 over the groove wall 56 into the guide groove extension portion 55, and by moving the movable rail 13 back and forth two or three times at a position close to the side frame 4, the screen 11 can easily be returned.

As described above, the aforementioned screen device has common upper and lower frame material 2 and 3, and also forms the upper and lower corner linking materials 6 and 8 to be vertically symmetrical to 7 and 9, with the exception of the winding mechanism 20 and the stopper mechanism 40.

Further, both edges of the winding shaft 12 are supported on the supporting face of the corner linking materials 6 and 8 via the washers 36 and 53, so as to be capable of rotating, and can be used smoothly even if the screen 1 is turned upside down.

By making such a retractable screen device capable of turning upside down, the hanging side is changed between left and right sides in the case illustrated herein of the single opening screen device, and a user-friendly screen device can be installed.

Figure 5:
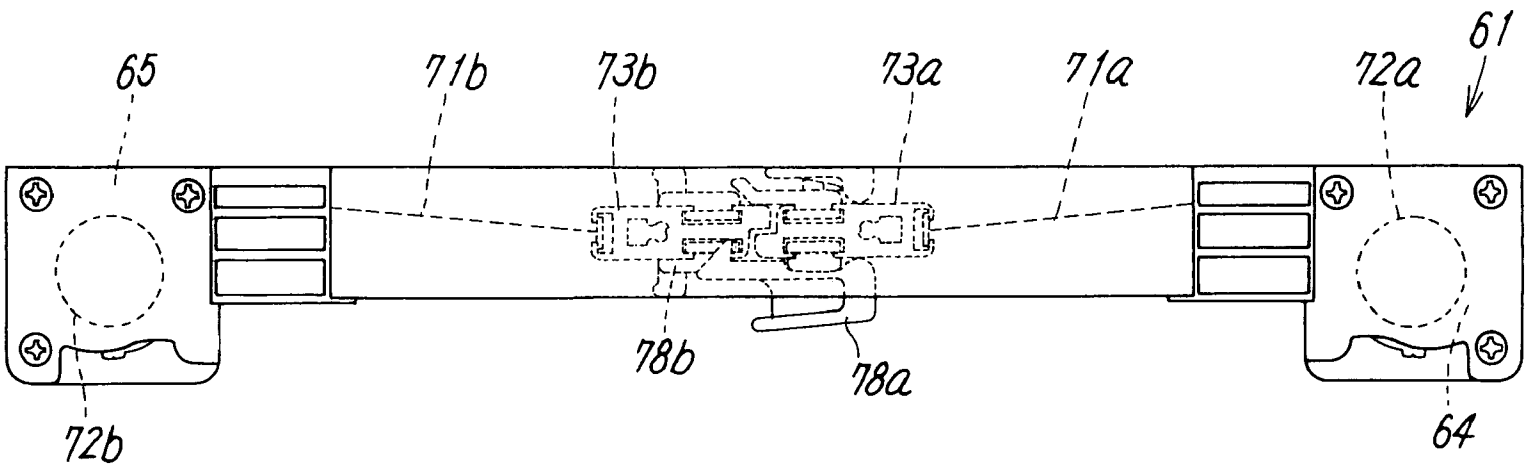
FIG. 5 is a plan cross-sectional view illustrating a second embodiment of a retractable screen device relating to the present invention.

FIG. 5 illustrates the second embodiment of the present invention, and this embodiment illustrates the case in which the screen device opens on both sides.

In the case of this second embodiment, compared to the above-described first embodiment, left and right side frames 64 and 65 that comprise a screen frame 61 have the same configuration as the side frame 4 of the above embodiment, which are configured by winding boxes that have winding shafts 72*a* and 72*b* for screens 71*a* and 71*b*, and therefore movable rails 73*a* and 73*b* that are fixed on the front edges of the left and right screens 71*a* and 71*b* are provided with respective engaging latches 78*a* and 78*b*. In other words, by using the same configuration for the side frame 5 as the side frame 4 of the screen device in the aforementioned first embodiment, the screen device can be used as the double opening type of the second embodiment, simply by taking into consideration using mutually engaging latches for the movable rails.

Now, the construction of the second embodiment other than that described above does not differ from the case of the first embodiment, and so the description thereof will be omitted.

According to the retractable screen device of the present invention described in detail above, with a screen device wherein a screen is wound onto a winding shaft that uses a spring as a drive source, and automatically rewinds this screen, in the case of installing this onto a building opening portion, the upper and lower frame material and the left and right side frames of the screen frame are cut to the necessary length corresponding to the dimensions of the aforementioned opening portion, and can be adjusted easily to the dimensions that fit with the size of that opening, and when such dimension adjustment is performed, adjusting the winding force of the aforementioned winding mechanism and setting the screen pullout limit can also be easily performed.

Further, even if the upper and lower edges of the screen derail from the guide groove, rewinding the screen can be performed smoothly.

The invention claimed is:

1. A retractable screen device comprising:

a screen frame formed by elongated parallel upper and lower frame members having a fixed cross section along their entire axis, elongated parallel right and left side frames having a fixed cross section along their entire axis, and corner linking members linking axial ends of said frame members and side frames together at four corners of said screen frame;

a movable rail formed by an elongated rail member having a fixed cross section along its entire axis, and having axial ends supported slidably by said upper and lower frame members;

a hollow winding shaft situated within one of said side frames along its axis and supported rotatably about its own axis by said corner linking members located at ends of said one side frame, said winding shaft being open at both ends;

a screen having one of its right and left edges wound about said winding shaft, the other of its right and left edges being linked to said movable rail;

one of said corner linking members at the ends of said one side frame carrying a winding mechanism configured to rotate said winding shaft about its axis by an urging force stored adjustably in a spring, said winding mechanism being axially movable for insertion into and removal from said winding shaft so that when said winding mechanism is within said winding shaft, said winding mechanism is engaged with said winding shaft about the shaft's axis to transmit the urging force of said spring thereto;

the other of said corner linking members at the ends of said one side frame carrying a stopper mechanism configured to restrict a degree of unwinding of said screen by the rotation of said winding shaft, said screen having an adjustable limit of unwinding, said stopper mechanism being axially movable for insertion into and removal from said winding shaft so that when said stopper mechanism is within said winding shaft, said stopper mechanism is engaged with said winding shaft about the shaft's axis to restrict a degree of unwinding of said screen to said limit of unwinding;

wherein said stopper mechanism comprises a second clutch mechanism attached to said corner linking member carrying said stopper mechanism, a screw shaft connected to said second clutch shaft and situated within said winding shaft, a nut engaged threadedly with said screw shaft and situated within said winding shaft so as to have it engaged with the inner surface of said winding shaft about the shaft's axis to rotate therewith and move threadedly along said screw shaft with the rotation of said winding shaft, and a stopper secured to said screw shaft and situated within said winding shaft to define a limit to the threaded movement of said nut, said nut being movable threadedly along said screw shaft toward said stopper with the rotation of said winding shaft in the direction of unwinding of said screen; and said second clutch mechanism including an operating wheel carried by said corner linking member carrying said stopper mechanism and operable externally to transmit its rotation to said screw shaft to adjust said limit of unwinding of said screen, while preventing said screw shaft from being rotated by a rotating force transmitted from said winding shaft.

2. A retractable screen device comprising:

a screen frame formed by elongated parallel upper and lower frame members having a fixed cross section along their entire axis, elongated parallel right and left side frames having a fixed cross section along their entire axis, and corner linking members linking axial ends of said frame members and side frames together at four corners of said screen frame;

a pair of movable rails each formed by an elongated rail member having a fixed cross section along its entire axis, and having axial ends supported slidably by said upper and lower frame members;

a pair of hollow winding shafts each situated within one of said side frames along its axis and supported rotatably about its own axis by said corner linking members located at ends of said one side frame, said winding shaft being open at both ends;

a pair of screens each having one of its right and left edges wound about one of said winding shafts, the other of its right and left edges being linked to one of said movable rails;

one of said corner linking members at the ends of each of said side frames carrying a winding mechanism configured to rotate one of said winding shafts about its axis by an urging force stored adjustably in a spring, said winding mechanism being axially movable for insertion into and removal from said one winding shaft so that when said winding mechanism is within said one winding shaft, said winding mechanism is engaged with said winding shaft about the shaft's axis to transmit the urging force of said spring thereto;

the other of said corner linking members at the ends of each of said side frames carrying a stopper mechanism configured to restrict a degree of unwinding of one of said screens by the rotation of said one winding shaft, said one screen having an adjustable limit of unwinding, said stopper mechanism being axially movable for insertion into and removal from said one winding shaft so that when said stopper mechanism is within said one winding shaft, said stopper mechanism is engaged with said winding shaft about the shaft's axis to restrict a degree of unwinding of said one screen to said limit of unwinding;

wherein said each stopper mechanism comprises a second clutch mechanism attached to said corner linking member carrying said each stopper mechanism, a screw shaft connected to said second clutch shaft and situated within said winding shaft, a nut engaged threadedly with said screw shaft and situated within said winding shaft so as to have it engaged with the inner surface of said winding shaft about the shaft's axis to rotate therewith and move threadedly along said screw shaft with the rotation of said winding shaft, and a stopper secured to said screw shaft and situated within said winding shaft to define a limit to the threaded movement of said nut, said nut being movable threadedly along said screw shaft toward said stopper with the rotation of said winding shaft in the direction of unwinding of said screen; and said second clutch mechanism including an operating wheel carried by said corner linking member carrying said each stopper mechanism and operable externally to transmit its rotation to said screw shaft to adjust said limit of unwinding of said screen, while preventing said screw shaft from being rotated by a rotating force transmitted from said winding shaft.

* * * * *